United States Patent [19]

Cox

[11] Patent Number: 4,611,759

[45] Date of Patent: Sep. 16, 1986

[54] NOZZLE

[76] Inventor: James P. Cox, 246 E. Bartlett Rd., Lynden, Wash. 98264

[21] Appl. No.: 488,675

[22] Filed: Apr. 26, 1983

Related U.S. Application Data

[63] Continuation-in-part of Ser. No. 336,762, Jan. 4, 1982, abandoned.

[51] Int. Cl.[4] ..... B05B 3/00

[52] U.S. Cl. ..... 239/229; 239/489; 239/602; 406/92

[58] Field of Search ..... 239/225, 229, 264, 461, 239/462, 486, 487, 489, 498, 602, 500-502; 406/92, 191, 196, 198; 55/236

[56] References Cited

U.S. PATENT DOCUMENTS

| | | | |
|---|---|---|---|
| 1,546,714 | 7/1925 | Buzbee | 239/229 |
| 2,509,817 | 5/1950 | Foreman | 55/236 |
| 2,601,655 | 6/1952 | Young | 239/229 |
| 2,661,194 | 12/1953 | Katovsich | 406/92 |
| 2,700,577 | 1/1955 | Oace | 239/229 |
| 2,744,786 | 5/1956 | Whitehead | 239/229 |
| 2,758,874 | 8/1956 | Snyder | 239/229 |
| 2,977,963 | 4/1961 | Klint | 239/229 |
| 3,490,654 | 1/1970 | Fischer | 406/196 |
| 3,692,243 | 9/1972 | Breunsbach | 239/602 |
| 3,719,207 | 3/1973 | Takeda | 406/92 |
| 4,332,292 | 6/1982 | Garberick | 239/229 X |

FOREIGN PATENT DOCUMENTS

| | | | |
|---|---|---|---|
| 629579 | 9/1949 | United Kingdom | 239/229 |

*Primary Examiner*—Joseph F. Peters, Jr.
*Assistant Examiner*—Daniel R. Edelbrock
*Attorney, Agent, or Firm*—Hughes & Cassidy

[57] ABSTRACT

A nozzle for expelling a fluid stream and dispersing and/or mixing same with(in) an ambient fluid is comprised of a resiliently flexible tube having an effective length at least equal to one harmonic wavelength of a coupled fluid stream for flexural resonant vibration of the tube as the stream is conducted therethrough, wherein the tube has a transverse cross-sectional profile and a longitudinal cross-sectional profile, at least one of which possesses a motion-affecting geometric gradient. The tube of the nozzle may include vanes disposed for creating turbulence within the ambient fluid. The nozzle is preferably formed from an elastomeric material and includes an enlarged, plastically deformable shoulder region at its proximal end for radial distention upon passage of any particulate material within the fluid stream having a dimensional aspect in excess of the bore dimension of the tube.

9 Claims, 29 Drawing Figures

NOZZLE

CROSS REFERENCE TO RELATED APPLICATION

This application is a continuation-in-part of copending application Ser. No. 336,762, filed Jan. 4, 1982, entitled "Effluent Treatment Apparatus and Method of Operating Same"; incorporated herein by reference and relied upon. The aforesaid copending application Ser. No. 336,762, of which this application is a continuation-in-part, has been abandoned and replaced by copending application Ser. No. 773,416, filed Sept. 6, 1985, entitled "Effluent Treatment Apparatus And Method Of Operating Same", a divisional application based thereon.

BACKGROUND OF THE INVENTION

1. Field of the Invention

The present invention relates, generally, to nozzles for conducting and expelling a fluid stream and dispersing and/or mixing same within an ambient fluid; and, more especially, to such a nozzle including a resiliently flexible tube which serves as the discharge member. The nozzles of the present invention are particularly well adapted for use in the injection of a fluid within an air treatment apparatus such as a wet scrubber or the like; but also have diverse applications in the mixing or other interaction of fluids and fluid streams regardless of the environmental setting.

2. Description of the Background Art

The present inventor's related, copending applications Ser. Nos. 336,762 (now abandoned) and 773,416 disclose and claim a wide range of air treatment apparatus for conditioning an effluent stream, which apparatus include one or more fluid injection nozzles comprising a length of resiliently flexible tubing, such as elastomeric tubing, for the introduction of a conditioning agent to a treatment zone of the device. Those nozzles overcome many of the inherent problems historically experienced in respect of wet scrubbers, among which may be mentioned high operation costs in order to achieve fine enough fluid dispersion, nozzle plugging, and the related inability to recirculate efficiently the conditioning agent. Attention is invited to those related applications for greater elucidation upon those and other advantages of the nozzles disclosed and claimed therein.

Numerous, diverse types of treatment apparatus have been devised over the last several decades for the conditioning of effluent streams, and particularly gaseous effluent streams, generated during industrial processes. A principal impetus for the development and use of such devices has arisen as a consequence of environmental conscientiousness in an effort to abate pollution. Thus, myriad designs have been proposed for the classification of particulate, the elimination of toxic, noxious or malodorous constituents, or the alteration (actual or perceptual) of the constituents of an effluent before it is released to the atmosphere. Experience has shown that the need to meet ever-increasing standards imposed upon those who must discharge an effluent to the atmosphere has resulted in the need to resort to very complicated, and hence expensive, machinery.

Various types of devices have been utilized to classify, segregate, or otherwise remove particulate material from a gaseous effluent stream. Conventionally, cyclone separators, electrostatic precipitators, so-called "bag houses" and plenum scrubbers have been employed for this task. Each type of device offers some advantage over the others but each has important limitations from either operational or cost-effectiveness points of view.

Conventional cyclone separators work fairly well for the classification of particles having nominal sizes greater than about 25–30 microns. As the particulate to be removed falls within progressively lower size ranges, the effectiveness of a conventional cyclone separator falls off precipitously. Typically, for particles less than about 10–15 microns, a normal cyclone separator is found to be virtually ineffectual. Yet, it is currently envisioned that particles an order of magnitude smaller (e.g., aerosols) will require removal from effluent generated during various industrial processes.

Some have attempted to improve the ability of a cyclone to classify smaller particulates by the injection of fluid agents within the treatment zone of the device. The normative wisdom in this regard indicated that the fluid would effectuate an increase in the mass of smaller particulate, thereby increasing the apparent size thereof insofar as classification is based upon centrifugal separation which, in turn, is directly related to the mass of the particulate to be classified. But, such prior attempts have normally diminished the overall operational efficiencies of the cyclone since the fluid injection has resulted in a diminution in field or kinetic energy of the vortical flow of effluent-entrained particulate. By and large, therefore, there has been no development of commercially-acceptable wet cyclone devices.

Electrostatic precipitators are viewed to work very well for removing small particulate from an effluent gas stream. Nonetheless, complete commercial integration of electrostatic precipitators as a uniform mode of air treatment to remove particulate is unlikely to occur since these devices are quite expensive and, thus, cost-prohibitive for many applications. To a lesser extent, but equally applicable, are the sometimes prohibitive costs involved in the installation of bag houses.

Another approach for particulate removal is by means of a plenum scrubber. These devices rely upon the expansion of the effluent stream by introducing the flowing stream into a large chamber. The accompanying pressure drop tends to strip particulate from the effluent. Oftentimes, fluid treatment agents are caused to pass in counter-current relationship vis-a-vis the direction of effluent flow. These devices are fairly efficient within fairly confined limits.

Packed bed scrubbers have offered another option for effluent treatment; that effluent passing through a bed of, e.g., spherical elements typically bearing a liquid treatment agent injected within the device. The packing increases the available surface for interactive contact between agent and effluent to be treated thereby. A problem customarily encountered in operation of these scrubbers is plugging within the bed due to particulate in the effluent lodging within interstices in the packing, leading to channeling and then dramatic diminution in scrubber efficiency. Somewhat related, at least in a conceptual sense, to packed bed scrubbers are fluid solid scrubbers such as those used in the treatment of effluent emanating from sewage treatment operations and in the treatment of stack gases emitted from oil or fossil-fired plants to remove sulfur dioxide therefrom. In the former case, activated carbon particle beds are utilized whereas the latter employ, for example, calcium carbonate or like ores. Activated carbon beds are both inefficient and very expensive to operate. The carbon materials require regeneration after relatively short cycling times or complete replacement. Operational costs can be high, considering the fact that some devices require pressure drops of six inches of water or more to drive the effluent through the bed. The scrubbers utilized to remove sulfur dioxide from stack gases routinely are extremely large devices, a requirement made necessary in order to achieve adequate residence time of the effluent in proximity of the treating ore (e.g., calcium carbonate).

Further along these lines, not infrequently it is mandatory both to remove particulate and also to remove or treat undesirable fluid or gaseous components entrained within an effluent stream. Customarily, regardless of the device employed for conditioning the effluent, suitable chemical agents are included within a fluid caused to contact or otherwise interact with the effluent. Gases may be reacted for removal or adsorbed or absorbed on or within a liquid treatment agent. Fluids may likewise be reacted, mixed, coagulated, or otherwise altered sufficiently to effectuate removal from the effluent.

A persistent difficulty heretofore experienced in respect of the injection of fluid treatment agents within an air treatment apparatus results from limitations inherent in the fluid injection devices employed. Quite routinely, fluid treatments agents, which usually must be finely dispersed to be optimally effective, are introduced via nozzles such as sintered nozzles having relatively small fluid passages. Other approaches, which attempt to minimize the need to use these fairly expensive nozzles, nonetheless typically require discharge orifices of relatively small size in order to insure adequate atomization or dispersion of the fluid treatment agent. Virtually all such approaches result in the use of fluid injection nozzles highly prone to plugging if even very small size foreign particulate finds its way within the fluid distribution system. This has all but eliminated the ability to use conventional filtration as a means for permitting recirculation of treatment fluid. Thus, the approach typically employed is to meter as best as possible the theoretical, optimum amount of treatment agent for reaction with the components in the effluent to be removed without including any excess. While this may seem fine on paper, in a plant many problems may be faced. If less than an appropriate amount of agent is injected into the air treatment apparatus, there will be incomplete reaction with the constituents to be removed and, accordingly, discharge of untreated effluent. If one attempts to compensate to insure virtually complete reaction, there is characteristically added an excess of agent which cannot be recovered and reused, contributing to an increased cost of operation and, perhaps, contributing to other sources of potential pollution since the remaining active components usually cannot simply be discharged to a sewer system. Even in cases where the conditioning agent is simply water, the copious quantities required in many installations ultimately results in considerable difficulties respecting waste water disposal as recirculation may not be an effective expedient.

Insofar as the present invention advantageously merges the concepts of certain prior art nozzles, adapting same specifically for use in conjunction with effluent treatment apparatus to overcome operational problems of the nature aforesaid and incorporating modifications to extend the operational utilities thereof, some background on the characteristics of these nozzles is appropriate. The class of nozzles involved are those which dispense a pressurized fluid, typically a liquid, through a flexible tube. As pressurized fluid flows through the tube and discharges therefrom, a reactionary force is felt within the tube wall. By carefully mating the wave mechanics of the flowing fluid with the mechanical properties of the flexible conduit, a standing or resonant flexural vibrational wave may be established in the tube itself.

This phenomenon has been recognized in various prior art devices where the flexural vibration of a tube is employed to some beneficial end. For example, irrigation or lawn sprinklers have been devised which rely on an oscillatory motion of a flexible tube when pressurized water discharges therefrom. Exemplary of such devices are those disclosed in U.S. Pat. No. 141,632, No. 3,030,031 and No. 2,930,531. This general principle has also been applied to the atomization of a liquid, and a representative device for this purpose is disclosed in U.S. Pat. No. 3,123,302. Other nozzles where a spray is created by conveying a pressurized fluid through a flexible tube are disclosed in U.S. Pat. No. 2,417,222 and No. 2,758,874. The latter of these two patents is further noteworthy insofar as it discloses a means for controlling the spray by including an outer sleeve on the flexible tube which may be slid along the length thereof. A dishwasher making use of these types of nozzles is the subject of U.S. Pat. No. 2,977,963.

The flexible injection nozzles of the present inventor's copending application Ser. Nos. 336,762 (now abandoned) and 773,416 have been found to be advantageously implemented in association with various types of air treatment apparatus and eliminate the historical impediments to the efficient removal of particulate for treatment of effluent in a wet scrubber device. The rapid oscillatory motion of the resonating flexible tube and fine dispersion of fluid issuing therefrom has been found to provide excellent coverage of effluent to be treated, while physical characteristics of the tube allow for virtually plug-free operation permitting recirculation of treatment fluid; all of which advantages contribute not only to the efficiency of treatment but permit dramatically reduced operating costs. Notwithstanding the acclaim accorded the devices which are the subject of the aforenoted application, continuing investigations have led to the recognition that other features in the operation of these types of nozzles may well be desirable depending upon the demands of a given task at hand. For example, the desire is not recognized to provide a tailored discharge tube to control the gross spray pattern (as distinguished from the dispersion spray pattern) by controlling the surface described by the resonating flexural tube. The ability to recirculate treatment fluids without elaborate filtration has led to the recognition of a desire to accommodate very large particulate material which may have a dimensional aspect greater than the fluid bore of the resilient discharge tube. In situations where the treatment fluid (whether liquid, gas or mixtures thereof) is introduced within a principally gaseous environment such as the case in the treatment of a gaseous effluent within a wet scrubber, it has been recognized that a desire exists either to replace or augment fans which drive the effluent stream. In like vein, where the pressurized treatment fluid is introduced into a principally liquid ambient, a desire is recognized for some means to replace or augment the requirement of, e.g., a mechanical mixer. It is also deemed desirable in the context of gaseous effluent treatment to introduce that effluent and the treatment agent therefor to the conditioning apparatus (e.g., plenum) as an intimate admixture thereof, a particularly beneficial goal where aerosols must be removed.

SUMMARY OF THE INVENTION

The present invention, as an improvement over and refinement upon that disclosed in the present inventor's referenced applications, responds to the desires identified above. The improved design of the instant nozzle allows the fabricator to tailor with considerable precision the discharge surface or surfaces described by the resonating flexible tube in order, in turn, to tailor the spray divergence of pressurized fluid emanating from the resonating tube allowing, for example, unidirectional discharge, discharge over an arcuate surface, discharge over a precessing, generally arcuate surface, as well as discharge over a planar surface, to name a few. The present design is one which accommodates the presence of relatively large particulate within the treatment fluid, as may be encountered upon recirculation thereof, including particulate having a dimensional aspect even in excess of the inner bore dimension of the resonating tube and yet permit operation of the nozzle virtually without plugging. Another advantage of the present invention is its ability to be adapted easily and efficiently to function as a type of fan means, in the sense that the energy imparted to the resonating tube may be recovered and utilized efficiently to create turbulence within a gaseous stream and in a controlled manner respecting its directional sense to move that gas in the nature of a fan. Still further along these lines, a similar adaptation yields the advantage of imparting turbulence within a liquid ambient within which the nozzle is disposed to convert otherwise wasted energy upon resonant oscillation of the discharge nozzle into mechanical mixing of the ambient.

The foregoing, and other advantages, are achieved in one aspect of the present invention by a nozzle for expelling a fluid stream in a dynamically variable pattern, comprising a resiliently flexible tube (such as an elastomeric tube) having an effective length at least equal to one harmonic wavelength of a coupled fluid stream for flexural resonant vibration of the tube as the stream is conducted or moves therethrough and ultimately issues therefrom, wherein the tube has a transverse cross-sectional profile and a longitudinal cross-sectional profile at least one of which possesses a motion-affecting geometric gradient for controlling the variable spray pattern. The dynamically variable path is achieved upon the occurrence of flexural movement of the tube, the stream issuing therefrom during that operation describing a surface upon discharge—i.e., a discharge surface. Controlling the geometric gradient(s) of the cross-sectional profiles of the tube provides the ability to control the shape of that discharge surface. For example, tubes having either a generally circular transverse cross-section with an elliptical fluid bore or a generally elliptical transverse cross-section with a generally circular fluid bore will tend to oscillate along the line of the minor elliptical axis, thereby describing a planar discharge surface. The tube of the nozzle has a bore for conducting the fluid stream, a proximal end retained on or by a fitting, and a distal end from which the fluid issues; and most preferably is designed to include an enlarged, plastically deformable shoulder region at the proximal end for radial distension upon passage or particulate matter having a dimensional aspect even in excess of the bore diameter of the tube. That proximal region further preferably includes an enlarged throat as well. It is also preferred that the shoulder region project outwardly or beyond the portion of the tube secured on or by the fitting, thence preferably tapering toward the distal end, whereby the most active resonant vibration occurs beyond the fitting.

In many cases it may be desired to entrain particulate within the fluid stream admitted to the nozzle; viz., a fluidized particulate stream. Improvements in the operational characteristics of the nozzle are achieved by configuring the internal bore geometry for centralizing particulate flow substantially along the axis of the tube and, hence, minimizing abrasive contact between the fluid and the elastomeric tubing. For example, an axially stepped geometry may be provided by including a plurality of annular rings in generally spaced relationship along the length of the discharge tubing, centralizing particulate flow through the apparently reduced bore provided by the rings in a collective sense. Alternatively, a land-and-groove type geometry may be utilized to this same end, the twisting or spiralling grooves provide a preferential path for fluidizing gas or liquid thereby tending to confine fluid particulate flow generally along the axis of the tube.

In another aspect of the present invention, the energy imparted to the tube by fluid flowing therethrough (creating the resonant flexural vibration thereof) may be utilized as a source of creating turbulence within the ambient fluid itself. Along these lines, the external tube geometry preferably includes vane means for creating that turbulence in the ambient during oscillation of the tube. Where the ambient is principally a gaseous one, the external geometry of the tube may be formed with a pair of radially extending vanes disposed asymmetrically as respects the axis of the tube to define a leading edge, tapering toward a trailing edge and joined across a contoured fan surface. In that manner, the component of resonant flexural vibration in the direction of the leading edge will be recovered as a force in the nature of a fan force on the gaseous ambient while the smoother contour of the trailing edge will permit the component of resonant flexural vibration in that direction to cause smoother movement through the gaseous effluent; thereby creating a generally unidirectional fan force either augmenting fans employed for that purpose or, under certain circumstance, allowing for replacement thereof. Disposition of the vanes in a more symmetrical sense allows the mechanical energy of the oscillating tube to be employed to good advantage in mechanical mixing; whereby the nozzle may replace mixers or the like disposed within a liquid ambient.

Other advantages of the present invention, and a fuller appreciation of its structure and mode of operation, will be gained upon an examination of the following detailed description of preferred embodiments, taken in conjunction with the figures of drawing, wherein:

DETAILED DESCRIPTION OF THE INVENTION

Figure 1:
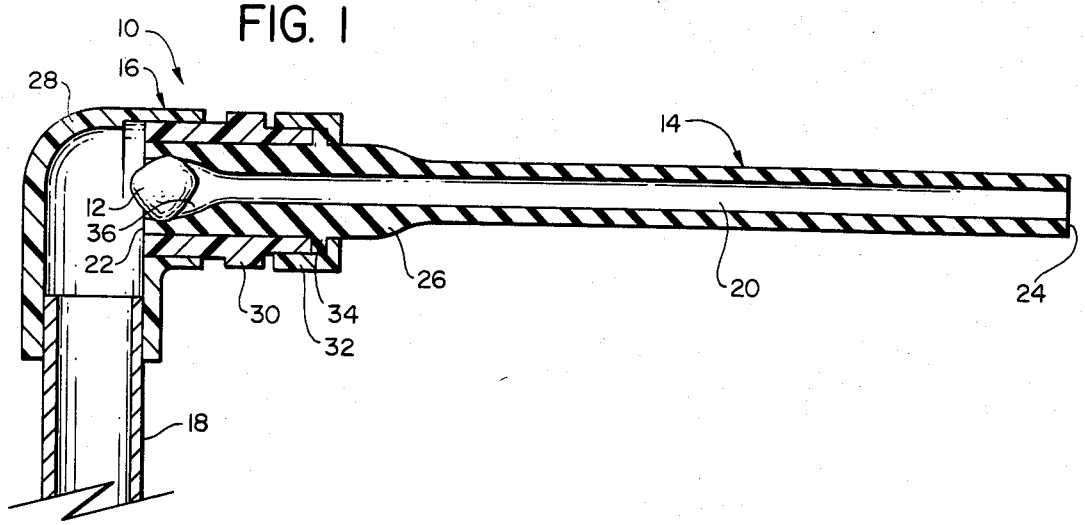
FIG. 1 is a sectional view of a preferred embodiment of a nozzle in accordance with the present invention, showing particulate entering a throat region thereof.

The present invention relates, generally, to nozzles for expelling a pressurized fluid stream and dispersing and/or mixing same with an ambient fluid; and, more especially, to such a nozzle which includes a resiliently flexible tube capable of undergoing resonant flexural vibration serving as the dispersing and/or mixing member. The nozzle of the present invention is widely adaptable for diverse applications in the mixing of the fluids, regardless of the environmental setting, and may constitute a means for creating tailored, turbulent flow within the ambient fluid in addition to its function as a fluid injection member. In one preferred environmental setting, the present invention relates to effluent treatment apparatus for conditioning an effluent stream via the introduction of a fluid treatment agent capable of performing the conditioning upon contact or other interaction with same. Along these lines, and in its broadest aspects, the nozzle of the present invention may be employed in designing, modifying or retrofitting all manner and variety of effluent treatment devices which rely upon the benefits of fluid injection within a treatment zone wherein the effluent is conditioned. In that sense, the term "conditioning" as used herein is meant to connote a chemical or perceptual alteration and/or classification of the constituents comprising the ambient fluid such as an effluent fluid stream, particularly a gaseous stream, and most particularly a gaseous effluent stream containing noxious, toxic and/or malodorous components in fluid and/or solid form. Accordingly, this term (conditioning) is intended to comprehend the addition to, removal from or modification of any constituent within the effluent. A principal objective, in this vein, is the removal and/or treatment of undesirable solid, liquid and/or gaseous components from or within an effluent generated in an industrial process in order to render the same fit for discharge to the atmosphere. Thus, "effluent" or "fluid effluent" will be used to describe a stream which is a fluid or one having the attributes of a fluid (e.g., fluidized solids or slurries) within which may be contained or entrained solid or semi-solid matter along with gases and/or liquids destined for removal or conditioning treatment. It is also intended that the conditioning process includes the option of adding suitable odorants, deodorants or reodorants to the airstream should that be desired. With those thoughts in mind, the effluent is conditioned by contacting or interacting it with a "fluid conditioning (or "treatment") agent", by which term(s) it is intended to connote an agent which is or has the attributes of a fluid capable of effecting a conditioning process. Thus, the pressurized stream emanating from the nozzle(s) of the present invention may itself be constituted of a fluidized particulate stream or like slurry. Hence, while the invention will now be described with reference to certain preferred embodiments adapted for use within the aforementioned diverse contexts, those skilled in the art will appreciate that such a description is meant to be exemplary and not limitative.

Figure 2:
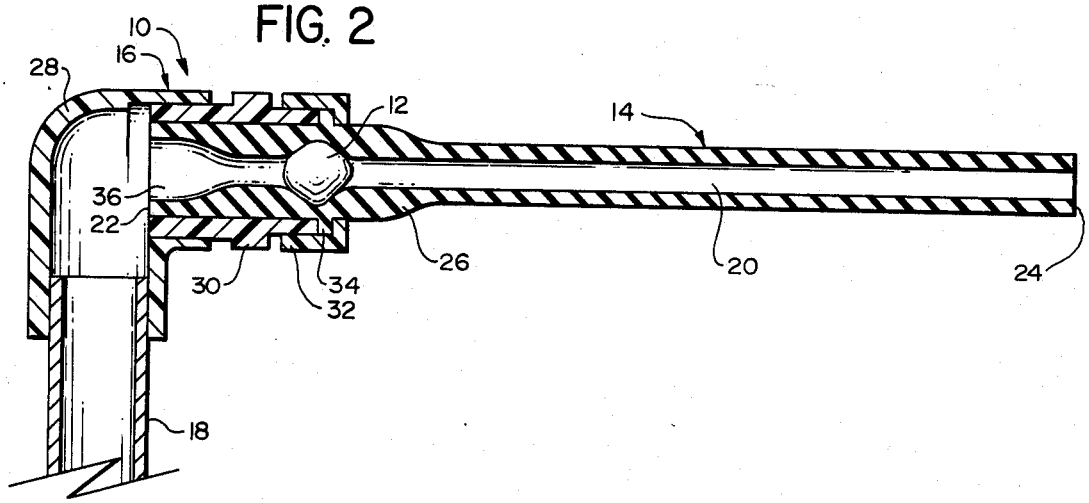
FIG. 2 is a view, similar to FIG. 1, illustrating the progression of particulate through a shoulder region of the nozzle.
Figure 3:
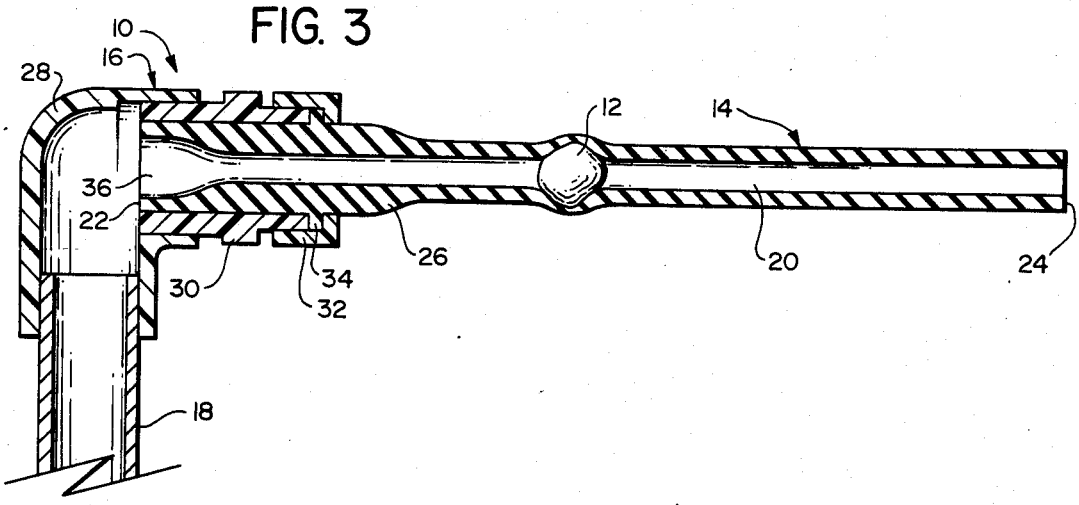
FIG. 3 is a view, similar to FIGS. 1 and 2, but showing further progression of the particulate into the medial region of the nozzle.

Turning to the figures of drawing, in each of which like parts are identified with like reference numerals, FIGS. 1-3 illustrate a preferred form of fluid injection nozzle in accordance with the present invention, designated generally as 10, showing the progression of foreign matter particulate designated generally as 12 through the nozzle. Before delving into the manner in which such foreign matter particulate may be expelled by the nozzle 10 without interference in its overall operation, a few general comments concerning that operation are warranted.

As set forth in the present inventor's copending application Ser. Nos. 336,762 (now abandoned) and 773,416, the subject nozzles include a flexible fluid discharge tube, designated generally as 14 in FIGS. 1-3; a tube preferably formed from an elastomeric material and most preferably silicone. (*Note,* any material falling within the ASTM definition of "rubber"—ASTM D1566-62T—may find good utility as the discharge tube for a nozzle in accordance with the present invention; but, for the sake of convenience, silicone will be exemplified throughout this specification). As pressurized fluid is transmitted through such a flexible tube, the flow force is coupled to the resilient tubing walls. Matching tube characteristics with the flow forces transfers the latter into a tendency for flexural movement of the tube. At an optimum correlation between the physical characteristics of the tube and fluid flow, one may achieve resonant flexural vibration—oscillation of the flexible tube 14, as considered in somewhat greater detail hereinbelow and also in the aforementioned copending applications. Hence, as the length of the tube 14 is the principal governing factor respecting flexural vibration thereof (all other factors being equal), oscillation occurs when the tube is sized to have an effective length at least equal to one harmonic wavelength of a coupled fluid stream as the stream passes through the tube. A very fine dispersion of fluid emanates from the tip of the tube 14 as the same moves in this oscillatory pattern. Two particularly distinct advantages are achieved as a consequence of this type of fluid control—the energy required to move the fluid through the relatively large bore of the flexible tube is substantially less than that required to develop as fine a droplet size in conventional nozzles while the tube nonetheless is capable of providing extremely fine dispersion of fluid and still accommodate the presence of foreign matter which would heretofore cause catastrophic plugging of conventional nozzles designed to achieve that very fine dispersion.

The foregoing benefits lead to the ability to employ a very simple recirculation loop when nozzles in accordance with the instant invention are utilized, for example, in wet scrubber devices. As opposed to the elaborate precautions required in the past if any attempt of recirculation was made, requiring the removal of particulate on the same order of size as the nozzle orifices in order to avoid plugging, particulate many orders of magnitude larger than the droplet size desired may now be accommodated, thereby permitting the use of, for example, simply a settling tank in the recirculation loop to segregate foreign matter from treatment agent. In further point of fact, this permits the use of an overabundance of treatment agent which may be captured and reused improving both the efficiencies of the overall system while eliminating the need for elaborate waste water treatment devices.

Returning to a consideration of the particular nozzle of FIGS. 1-3, the same is shown to be comprised of the flexible tube 14 restrained within a fitting designated generally as 16 communicating with a feed tube 18 for delivering pressurized fluid. The tube 14 includes a central bore or fluid port 20 spanning the same from the proximal end 22 to the distal end 24 thereof.

The tube 14 in this embodiment is formed with a shoulder region 26 at the proximal end, that shoulder serving myriad functions. The shoulder 26 has a thicker wall section than that of the medial or distal regions, providing the proximal end of the tube with somewhat greater physical integrity for disposition within fitting 16 and maintaining more active oscillation of the tube toward the distal end to minimize wear at the juncture of the tube and fitting. In this embodiment, the fitting is comprised of a standard elbow 28 at the terminus of pipe 18, a socket 30 having an inner diameter sized to accept the shoulder 26 and a retaining flange 32. Preferably, the shoulder region is formed with a circumferential lip 34 to be received between the end wall of socket 30 and flange 32 in order to secure the tube 14 within fitting 16 without the need to exert any radial compressive force. This structure provides the further advantage of minimizing path constriction upstream of the tube; any particulate too large to be expelled by the tube will lodge well in advance of the nozzle while that which passes through the fluid distribution system will encounter and pass through the nozzle unimpeded. It is also preferred that the proximal end of the tube be formed to include a slightly enlarged throat area 36 merging or tapering to the reduced diameter bore 20 in order to accommodate oversized particulate such as that identified as 12 and centralize same for ultimate expulsion.

With the advent of an ability to recirculate treatment fluid used in a wet scrubber in this straightforward fashion comes the increased probability of recirculating particulate material such as the particle of foreign matter 12. As the tube 14 dynamically oscillates in response to the head pressure on fluid conducted through feed line 18, any particulate having a major dimensional aspect approximately equal to or less than the diameter of bore 20 will very easily pass through the tube. However, it is to be contemplated that particulate having the dimensional aspect greater than the diameter of bore 20 will occasionally be recirculated, and this is the situation shown in FIGS. 1-3. Initially, the particle 12 will lodge within the throat region 36 at or near its juncture with bore 20. Depending upon its sphericity, the particle 12 may or may not completely close the bore, although the flow through the tube 14 will be at least partially obstructed. Regardless, due to the resilience of the material from which the tube 14 is made, an elastomer such as silicone, the head pressure upstream of the particle will begin to force it through the throat into the shoulder region 26 as shown in FIG. 2. The thicker wall section accomodates the presence and passage of particle 12 by plastic deformation as the particle progresses through the proximal end of bore 20. The resiliency of these preferred elastomeric materials also permits the return of the wall shape to the normal configuration as the particle moves through the tube. The head pressure upstream of particle 12 will eventually force it through the shoulder region 26 into the medial region of the tube 14 as shown in FIG. 3. The thinner wall sections within that area and outwardly to the distal end 24 readily accommodate particle 12 and present relatively little impeding force to its passage through the bore 20. Furthermore, in the event the particle 12 is of a highly irregular shape permitting some fluid to pass between it and the distended wall, there will be a tendency for erratic vibrational movement of the tube which will tend to assist in the expulsion of the particle. In any event, the particle 12 will continue its progress through the tube until ultimately ejected, allowing the resumption of normal, dynamic flexural resonance and fluid dispersion. Hence, the discharge nozzle 10 is capable of accommodating particulate material having a major dimensional aspect virtually approaching the diameter of the shoulder region 26 (i.e., to the limit of its compressibility—a variable depending upon the material selected), allowing for passage of particulate having a lesser dimensional aspect than that with relatively ease.

Figure 4:
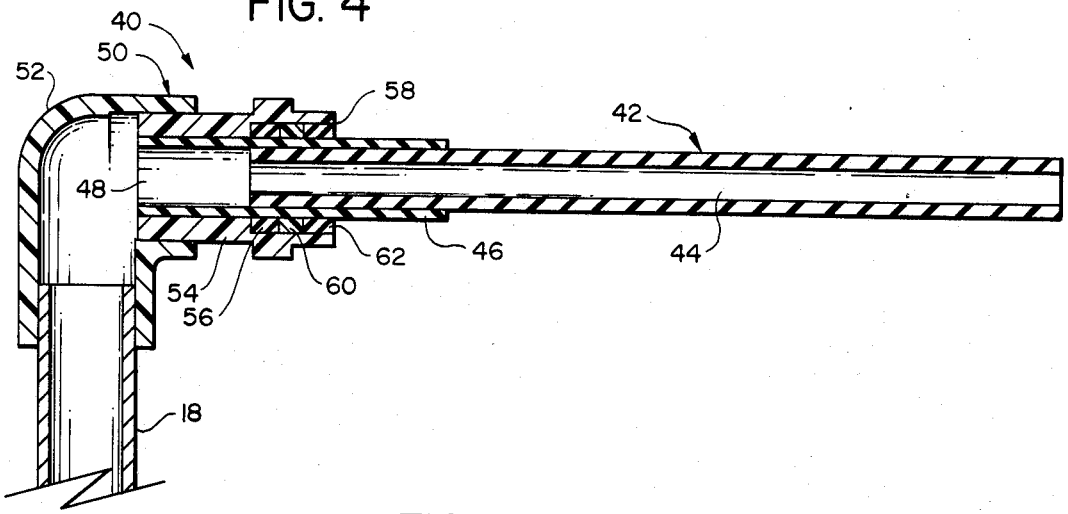
FIG. 4 is an alternate embodiment of a nozzle in accordance with the present invention, showing a modified version of the shoulder region at the proximal end thereof.

FIG. 4 shows an alternate embodiment of a nozzle, designated generally as 40, also configured to accept and accommodate the passage of particles such as that identified as 12 in FIGS. 1–3, having sizes which would cause catastrophic plugging of injection nozzles heretofore employed in wet scrubbers or the like. The nozzle 40 is comprised of a flexible tube 42 of an elastomer such as silicone having a bore 44. In this case, the tube 42 is received within a sleeve 46 also of an elastomeric material, the tube 42 terminating at its proximal end intermediate the length of sleeve 46 to yield a throat 48 comparable in function to throat 36. This composite tube/sleeve is received within and secured by a fitting 50 disposed at the terminus of feed pipe 18. The fitting 50 in this case includes an elbow 52 and socket 54 similar to the construction of the fitting 16. The nozzle 40 is preferably fabricated by securing the tube 42 within sleeve 46 by means of an adhesive to join or otherwise bond the two members together. When the most preferred composition of silicone is elected, any of the conventional silicone adhesives would thus be employed. The composite tube/sleeve is then disposed within the socket 54 and a bead 56 of, e.g., silicone is laid within a recess 58 of the socket. Prior to a cure of the bead 56, an annular ring 60 is optionally inserted within the recess 58 and pressed into mating contact with the bead. The ring may be metallic, polymeric or of such other generally rigid material as to provide integrity to the coupling. A second bead 62 is then laid within the recess outwardly of the ring 60 to conclude the joint. Optionally, the socket 54 may be drilled or pierced radially and silicone injected therein to contact and bond with the sleeve 46 and, upon cure, function as retaining dogs. Either construction yields a joint of good mechanical integrity.

The nozzle 40 is functionally equivalent to the nozzle 10, in the sense that particulate having a major dimensional aspect greater than the diameter of bore 44 will first be admitted through the throat 48 and thence come in contact with the extreme proximal end of the tube 42. The elastomeric composition employed for the tube and sleeve allows for radial expansion via plastic deformation in response to the head pressure driving that particle. Accordingly, the tube will distend radially permitting passage of the particulate and ultimate expulsion thereof from the distal end of the tube 42. Again, virtually plug-free operation is insured in this manner.

The foregoing structures of the instant nozzle, allowing for the presence of large particulate materials within the fluid stream expelled therefrom, lead to yet a further and highly important advantage previously unattainable a conventional effluent treatment apparatus. It cannot be gainsaid that the vast majority (if not all) effluent treatment apparatus of conventional design have introduced the effluent to be conditioned to a treatment chamber via one path and treatment agent via a second, discrete path; relying upon dispersion of the treatment agent within the treatment chamber or zone of the device and an appropriate residence time for the conditioning of the effluent. With the advent of the present invention, the ability to entrain conditioning agent within the effluent stream and discharge the admixture through a nozzle is now a technical reality and an advantage which should not be underestimated. The rapid oscillatory motion of the tip of the discharge tube provides an instantaneous pressure drop several orders of magnitude greater than those of conventional nozzles (in the nature of cavitation), both atomizing the conditioning agent as aforesaid and providing a homogenous and intimate admixture of effluent to be treated with agent for that purpose. Not only is treatment improved many fold, the extremely fine dispersion and intimate admixture reduces substantially the required residence time for contact and leads to the ability to reduce substantially the size of apparatus heretofore required for the purpose of achieving the prolonged residence times customarily required in these processes. And yet, all of this is achieved without substantial fear of plugging of the nozzle and without the need to employ large drive units (e.g., high-pressure pumps) with their associated energy penalty.

Figure 5:
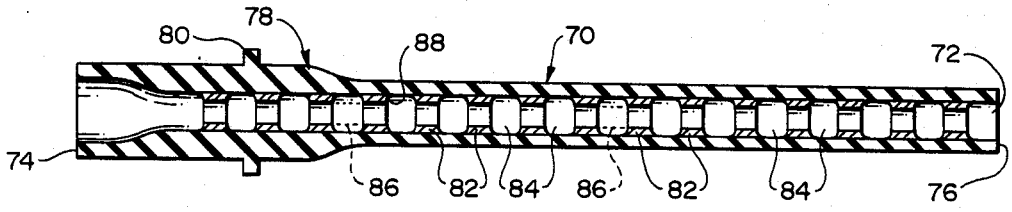
FIG. 5 is a fragmentary view of a nozzle in accordance with an alternate embodiment of the present invention, specifically configured to centralize particulate flow where the pressurized stream issuing through the nozzle is in the nature of a fluidized particulate stream.
Figure 6:
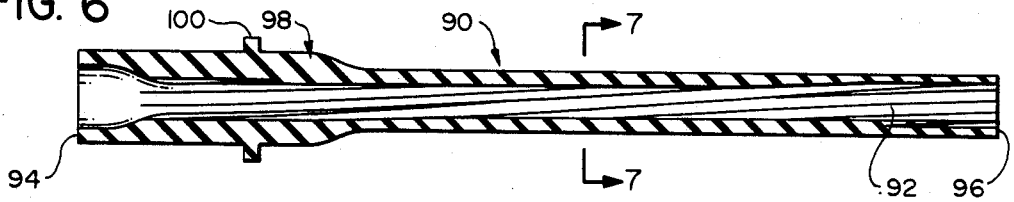
FIG. 6 is a view, similar to FIG. 5, showing another geometry adapted for centralizng fluidized particulate flowing through the nozzle.
Figure 7:
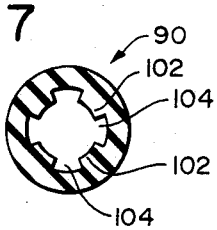
FIG. 7 is a sectional view, taken substantially along the line 7—7 of FIG. 6.

The embodiments shown in FIGS. 1–4 are designed to accommodate the presence of unwanted particulate and allow its ultimate expulsion for the respective discharge nozzles discussed above. However, it is equally well envisioned that other environmental settings require or may use to good advantage the presence of particulate in the pressurized stream discharged through the instant nozzles. One such application might be, for example, grit or sandblasting wherein a fluidized particulate stream would be discharged from the oscillating nozzle structure. Other preferred applications include the injection of fluidized carbon, calcium carbonate, activated aluminum or the like streams within an effluent treatment apparatus. In such instances, whether the fluid be liquid or gas, the longevity of the flexible tube member of the discharge nozzle is improved by minimizing contact between the abrasive particulate and the sidewalls of the tubing. FIGS. 5–7 illustrate various approaches for centralizing the particulate flow along the longitudinal axis of the tube and thereby minimizing abrasive contact and attendant wear.

FIG. 5 shows one embodiment of a tube, designated generally as 70, specifically configured for the discharge of fluidized particulate. The overall shape of the tube is similar to that of tube 14 illustrated in FIGS. 1–3. Accordingly, the tube 70 includes a bore 72 spanning the tube from its proximal end 74 to its distal end 76. A shoulder 78 is formed near the proximal end having an increased wall thickness merging or tapering to the relatively thinner section within the medial and distal regions of the tube. The shoulder includes a circumferential lip 80 for assisting in the retention of the tube within a suitable fitting.

The tube 70 departs from the construction of tube 14 in respect of the internal geometry of the bore 72 vice 20. In this latter case, the bore 72 is an axially stepped bore defined by a plurality of spaced ring elements 82 which define enlarged bore segments 84. As is apparent from FIG. 5, each of the ring elements 82 is an annulus having an inner diameter less than the inner diameter of each bore segment 84. Accordingly, each bore segment between successive ring elements, such as the one identified in phantom as 86, includes a radial expansion zone. As a fluidized particulate stream is admitted to the tube 70 via the proximal end 74, and progresses through the tube 70 establishing the resonant vibrational oscillation thereof, the particulate matter will tend to be centralized axially, flowing through the reduced diameter of the annular ring elements 82, while the fluidizing medium will assume a presence within the intermediate radial expansion zones 86 effectively isolating the tube sidewalls thereat. It is preferred that each ring element 82 includes slightly flaring edges 88 to reduce the otherwise abrupt or sharp geometry of the expansion zone in order to reduce eddying. Preferably, the ring elements 82 are ceramic rings fitted within the bore 72 in the illustrated spaced relationship, retained therein by slightly oversizing the outer diameter of each ring to provide a snug fit due to the resilience of the elastomeric tube. These ceramic rings, albeit rigid, will provide good wear resistance while centralizing the particulate material and, due to the spaced or segmented nature of their disposition within the bore, allow the tube to flex during its resonant oscillation across the bore segments 84. Consequently, abrasive particulate is effectively isolated from the more sensitive tube material while the tube nonetheless retains its characteristics for resonant flexural vibration.

FIGS. 6 and 7 show an alternate construction with these same aims in mind—centralizing abrasive particulate from the elastomeric tube in order to increase the longevity thereof. In this case, a tube designated generally as 90 includes a "riffled" bore 92 traversing the tube from its proximal end 94 to its distal end 96. A shoulder 98 is formed at the proximal end and, once again, includes a lip 100 to aid in retention of the tube within an appropriate fitting (not shown).

In this embodiment, the riffled bore 92 is provided by a spiral series of lands 102 and grooves 104. As the pressurized, fluidized particulate stream issues through the bore 92 establishing resonant flexural vibration of the tube 90, the land and groove configuration will impart a spiralling rotation in the flow. Particulate matter will have a greater tendency to be forced toward the axis of the tube while the fluidizing medium will have a greater tendency to expand within the grooves and the region immediately adjacent the lands. Consequently, the abrasion-sensitive elastomer from which the tube 90 is fabricated (e.g., silicone) is insulated from the abrasive, flowing particulate.

The foregoing embodiments, designed for the injection of fluidized particulates, have broad ranging applicability in diverse settings. The use of these nozzles for abrasive cleaning, such as sandblasting, gritblasting (in the cleaning of metals), may be easily visualized by those skilled in the art. Perhaps not so apparent is the adaptability of these structures in fluid-solid scrubbers of the type historically employed in the treatment of gaseous effluent accompanying sewage treatment and in the removal of sulfur dioxide from fossil-fueled furnaces. Each is considered very briefly in turn below.

Fairly noxous odors emanate from sewage treatment plants, and these have conventionally been passed through a bed of activated carbon for odor control prior to discharge to the atmosphere. The packed carbon beds, containing carbon particles usually in the range of from about 12 to 20 mesh, are provided for removal of these odors. While this has been the accepted mode of treatment for many years, it is attended with some very severe disadvantages. For example, the ability of carbon to cleanse the effluent is limited over time, and the beds require either replacement or regeneration. Yet, the cost of activated carbon can be quite high, while the cost effectiveness of regeneration is not very good. Further contributing to significant operational expense is the fact that these packed beds can require pressure drops up to or even in excess of 6 inches of water.

Using the nozzles in accordance with the present invention overcomes many of those operational difficulties and substantially reduces inefficiencies inhering in that approach. The injection of a finely divided fluidized stream of carbon increases substantially the surface area for contact with the effluent, and provides much greater adsorptive capabilities for the same quantity of activated carbon. Treatment chemical may be injected at the same time, and indeed may comprise the fluidizing medium in order to enhance the conditioning of the effluent. And, this is achieved at fairly low power requirements; for example, demanding pressure drops on the order of only about ½ to 1 inch of water versus perhaps 6 inches or more. And still, as noted generally above, it is entirely feasible to include the effluent to be treated as part of the fluidizing medium itself thereby discharging simultaneously within a treatment zone effluent to be treated, activated carbon, and treatment agent obtaining a fine, homogeneous dispersion of these feeds for maximum processing efficiencies.

The treatment of stack gases resulting upon the combustion of fossil fuels has proceeded in a fairly similar manner with an eye toward removal of sulfur dioxide. The difference has been the use of calcium carbonate or a similar ore to react with the sulfur dioxide component and remove same prior to discharge of the effluent to the atmosphere. The historical difficulties with this process entail the need for extremely large treatment chambers in order to achieve good residence time between the ore and the stack gas. Briefly stated, the nozzles in accordance with the present invention permit finely divided carbonate to be injected within a much smaller treatment zone as the increased surface area reduces the need for long residence time.

Figure 8:
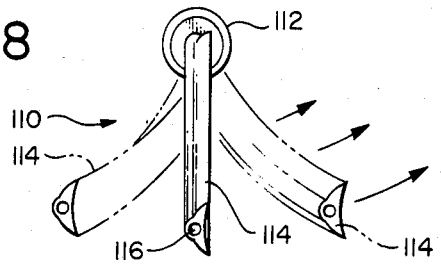
FIG. 8 is an isometric view of a nozzle in accordance with a preferred embodiment of the present invention, adapted to function as a fan or fan means as the nozzle undergoes flexural resonance and provide generally unidirectional fluid motive force on gaseous ambient fluid.
Figure 9:
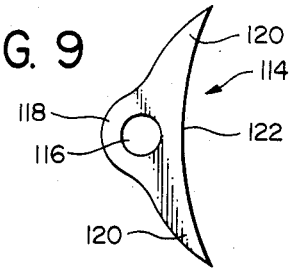
FIG. 9 is an end elevation view of the nozzle shown in FIG. 8, illustrating a high preferred fan vane geometry.

Thus far the description of the nozzles of the instant invention has been made with reference to generally circular cross-sections of the respective flexible tube elements thereof. However, it has been determined in accordance with the present invention that the oscillatory motion of the flexible tube may be tailored or controlled by employing a non-circular overall geometry, a non-circular bore through the tube, or asymmetric disposition of the bore relative to the longitudinal axis of the tube, and this control may then be adapted for some good advantage. Thus, in the sense that the gross movement of the flexible tube during its resonant flexural vibration describes a surface, the geometry of that surface may be tailored or altered to achieve various ancillary benefits beyond those detailed above. FIGS. 8 and 9 show one such implementation.

The embodiment of FIGS. 8 and 9 includes a nozzle designated generally as 110 secured in a fitting 112 for resonant flexural vibration thereabout. The nozzle in this embodiment is comprised of a flexible tube 114 having a bore or fluid port 116 therethrough. The tube 114 here is formed with a generally circular element or portion 118 within which the bore 116 is located. The outer geometry also includes first and second vanes 120 extending in a generally radial direction outwardly of the circular element 118. The vanes are joined along a contoured surface 122, completing the overall outer shape of the flexible tube.

The geometric shape of the tube 114 precludes oscillation or flexural vibration in a vertical mode due to the combined placement of the port 116 and the redial extension of the vanes 120; thus the tube will oscillate or flex only in a horizontal mode. Further, the symmetrical nature of the tube in a vertical plane limits the oscillation to a generally linear one, thus a horizontal plane through the center of bore 116 being described as shown by the arrows in FIG. 8 as the tube sweeps back and forth due to the flow of fluid through the port.

As the tube oscillates in the horizontal discharge plane, the vanes 120 and contoured surface 122 combine to effect a type of fan force. More specifically, viewing the extension of the vanes 120 radially outward from the circular tube element 118 to be a leading edge of the tube, and the surface of the circular element 118 as a trailing edge, oscillation of the tube in the direction of the leading edge will cause a force on a gaseous ambient in the nature of a fan force, pushing the ambient in the direction indicated by the arrows in FIG. 8. That is further augmented by the reentrant contour of the surface 122. On the other hand, the trailing edge side of the tube 114 has a smooth, somewhat aerodynamic profile allowing the tube to move in the direction of the trailing edge without creating substantial compressive force on the gaseous ambient immediately proximate the tube during this portion of its travel. Hence, as best visualized with reference to FIG. 8, the issuance of fluid from the tube 114 causing the same to resonante in a flexural mode will create a fan force thereby recovering the mechanical energy imparted to the tube by the moving fluid which otherwise would be lost, at least in part. FIGS. 10–13 illustrate various effluent treatment apparatus wherein flexible nozzles of this configuration find particularly good utility.

Figure 10:
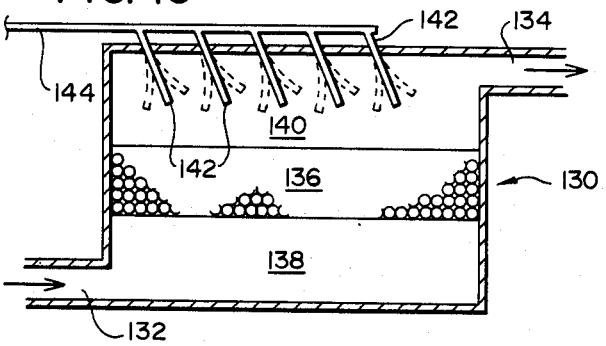
FIG. 10 is a diagrammatic illustration of a wet scrubber incorporating nozzles in accordance with the design shown in FIGS. 8 and 9, whereby the oscillatory action of the nozzles create a turbulent fan effect drawing effluent through the scrubber device.

FIG. 10 shows, diagrammatically, a packed bed scrubber, designated generally as 130, having an effluent inlet 132 for admitting a principally gaseous effluent to be treated and an outlet 134 for discharge thereof. The scrubber 130 includes a packed bed 136 of conventional design, separating the structure into a lower treatment zone 138 and an upper treatment zone 140. Disposed within the upper treatment zone are a plurality of fluid discharge nozzles 142 in accordance with the present invention, which receive pressurized treatment agent via a feed pipe 144. Each of the nozzles 142 is of the same design as that of the embodiment of FIGS. 8 and 9, disposed at a slight angle of inclination from the vertical for oscillation in a vertical plane. As fluid treatment agent is caused to traverse and thence issue from each of the nozzles 142, the same oscillate as described above. That component of oscillation toward the outlet 134 creates a fan force within the zone 140 for propelling the ambient (i.e., the effluent undergoing treatment) outwardly of the device. Concomitantly, fluid treatment agent is caused to saturate the packing within bed 136 for contact with admitted effluent to be treated. Deending upon the precise design utilized, the fan force achieved via the nozzles 142 may in fact be sufficient to draw effluent through the inlet 132 and lower zone 138, through the packing 136 and thence outwardly of the device. In any event, the nozzles 142 will either augment or replace altogether the fan customarily utilized to drive the effluent through the scrubber.

Figure 11:
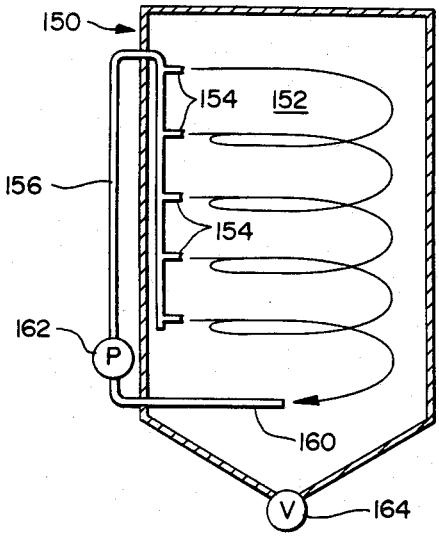
FIG. 11 is a diagrammatic, side sectional view of a plenum scrubber incorporating nozzles of the present invention, such as those illustrated in FIGS. 8 and 9, whereby the plenum is imparted with a type of cyclonic activity due to the fan effect of the nozzle members.
Figure 12:
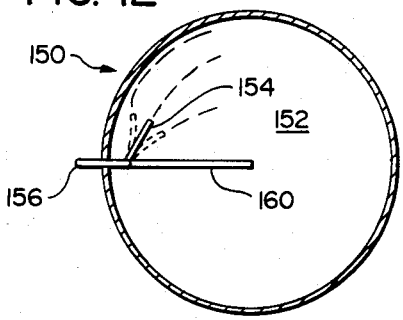
FIG. 12 is a top plan view of the plenum scrubber of FIG. 11, showing both the pattern of spray and fan action of the nozzles and a recirculation tube projecting into the lower region for continual use of fluid treatment agent.

FIGS. 11 and 12 illustrate a type of plenum scrubber, designated generally as 150. (*Note,* depending upon the manner in which the plenum scrubber is operated, the inlet and outlet for effluent will vary in placement, and have therefore been omitted simply for the sake of clarity as those skilled in the art will have no difficulty in locating that structure as may be required.) The plenum scrubber includes a confined treatment zone 152 wherein effluent to be treated will reside and be contacted with liquid treatment agent issuing from a plurality of nozzles 154 receiving fluid to be injected within the zone 152 via a feed pipe 156. Again, each of the nozzles 154 is of the form shown in FIGS. 8 and 9, whereby the injection of fluid will create a fan force as best visualized with reference to FIG. 12. In this instance, the nozzles are oriented to spray fluid generally tangentially with respect to the wall 158 of the treatment zone or chamber 152 and, concomitantly, create a spiral or whirling air force. With that orientation, the scrubber 150 thereby assumes the general characteristics of a wet cyclone separator where the nozzles themselves provide internal fan means for creating and maintaining a cyclonic or swirling motion of effluent to be treated while simultaneously saturating that effluent with finely dispersed droplets of treatment agent. This embodiment is further remarkable for the fact that a dip tube 160 is disposed within the lower reaches of the treatment zone 152, communicating with a pump means 162. As treatment agent is sprayed within the zone 152, it will knock down particulate and otherwise effectuate a conditioning treatment of that effluent while removed materials and sprayed fluid will collect in the lower, apical region of the scrubber. A tap valve 164 is provided at the apex to draw out settled solids while the dip tube 160 permits a very simple recirculation of fluid, drawn from the treatment zone and delivered to the nozzles via pump 162 and feed pipe 156. As noted in detail above, particulate which may also be withdrawn via tube 160 may readily pass through the discharge nozzles, including relatively large sized particulate, without precluding this very simple expedient of recirculation—a feature heretofore elusive in this environment.

Figure 13:
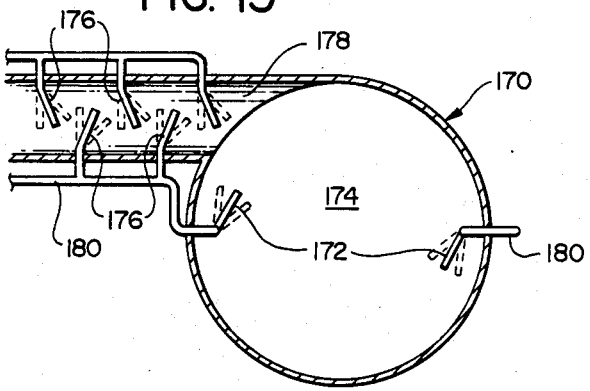
FIG. 13 is a view of a plenum scrubber similar to that of FIGS. 11 and 12, but wherein the inlet duct is further provided with fan-like nozzles such as those of FIGS. 8 and 9 in order to increase the injection velocity of effluent and improve upon the cyclonic effect achieved therein.

FIG. 13 illustrates diagrammatically a portion of a wet cyclone 170 incorporating nozzles in accordance with the present invention. In this embodiment there are two groups of nozzles, a first group 172 disposed within the treatment zone 174 of the apparatus (corresponding generally to the nozzles 154 in the embodiment in FIGS. 11 and 12) and a second group of nozzles 176 disposed within the inlet duct 178 of the cyclone (corresponding generally to the nozzles 142 in the embodiment of FIG. 10 in terms of functionality). In this instance feed pipes 180, which may or may not be part of a common or continuous tubing system, supply fluid to each of the nozzles for conditioning a gaseous effluent admitted to the device. The first group of nozzles 172 materially assist in the creation and maintenance of the cyclonic motion of effluent while the fluid emanating therefrom conditions the same. In like manner, the nozzles 176 of the second group provide additional fan-type force for moving effluent into the treatment zone while simultaneously providing treatment or appropriate pretreatment as may be desired or required. Collectively, the two groups of nozzles enhance substantially the efficiency of the scrubber, allow for the same sort of recirculation of treatment agent as was the case in respect of the embodiment of FIGS. 11 and 12, and provide these advantages at much lower operating costs than hisotrically experienced with these types of devices.

Figure 14:
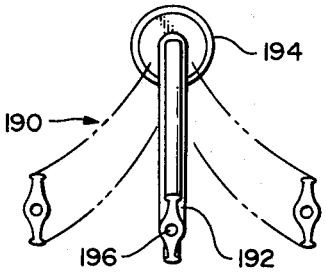
FIG. 14 is an isometric view of an alternate embodiment of a nozzle of the present invention, wherein the same includes generally symmetrical vanes for imparting turbulence to the ambient fluid upon oscillatory motion of the discharge tube, this embodiment functioning in the nature of a mechanical mixer for a fluid ambient.
Figure 15:
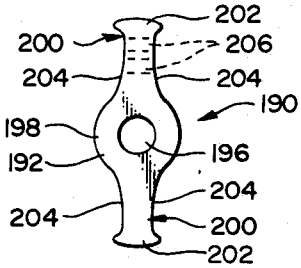
FIG. 15 is an end elevational view of the nozzle of FIG. 14, illustrating a preferred vane geometry therefor.
Figure 16:
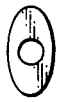
FIGS. 16–21, inclusive, are sectional views showing alternate cross-sectional profiles for the discharge tube of the nozzle in accordance with the present invention, all of which geometries provide oscillation describing a generally linear discharge motion in a generally horizontal plane as a discharge surface.
Figure 17:
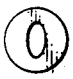
Figure 18:
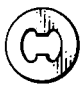
Figure 19:
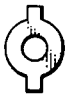
Figure 20:
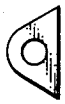
Figure 21:
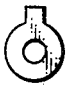

FIGS. 14 and 15 illustrate yet another embodiment of a discharge nozzle in accordance with the present invention, designated generally as 190. The nozzle 190 includes a flexible discharge tube 192 secured to and supported by a fitting 194 for flexural resonant vibration thereabout. A bore 196 is provided through the tube 192 in order to emit a pressurized fluid stream and, as a consequence, create flexural resonant vibration thereof.

The embodiment of FIGS. 14 and 15 is a variant of that of FIGS. 8 and 9. Like the latter, the tube 192 is comprised of a circular element 198 from which vanes 200 extend radially outward. Each of the vanes 200 terminates in a flange-like member 202 to yield contoured vane surfaces 204. However, unlike the embodiment of FIGS. 8 and 9, these vanes 200 are disposed symmetrically about the circular element so that neither face of the tube is favored in terms of the force developed upon flexural resonant vibration thereof within the ambient. In this particular instance, it is preferably a fluid ambient; albeit it is equally well envisioned that the construction of the nozzle 190 might be employed to good advantage within a gaseous ambient. The preference for this construction in combination with the injection of a fluid via the nozzle into a fluid medium is the mixing effect to be created upon discharge of fluid. In the context of this environment, it is further optionally preferred to include transverse apertures 206 through the vanes 200 as shown in phantom lines in FIG. 15. Recovery of the energy imparted to the nozzle tube 192 may thereby be utilized in place of mechanical mixers. It has further been determined that the structure of the nozzle 190 may be employed to a distinctly good advantage in the propulsion of water-borne craft simply by circulating water via a pump through the nozzle in order to create flexure thereof and transfer those flexural forces into forwardly disposed propulsion forces. In that environmental context, the optional apertures 206 are not included. Regardless of that consideration, suffice it to say that exceptionally good recovery of the mechanical forces imparted to the tube 192 may be achieved when the same is disposed within a fluid ambient.

As is now readily apparent from the foregoing description, the cross-sectional geometry of the flexible tube of discharge nozzle in accordance with the present invention provides means for oscillatory control of the tube. For example, the specific cross-section elected for the embodiments of FIGS. 8–9 and FIGS. 14–15 maintains oscillation in a generally linear direction to define a plane as the discharge surface. In other instances, placement of the fluid bore of the tube vis-a-vis one or more vanes or relative to the centerline or axis of the tube will cause the gross flexural movement of the tube to describe an arcuate surface. One step further than that, a circular surface may be defined, as related more particularly below.

FIGS. 16–23 illustrate various geometries for the discharge tube of a nozzle in accordance with the present invention in order to control the geometry of the discharge surface or sufaces. Each of the cross-sectional configurations of FIGS. 16–21 will yield linear gross oscillation and, in the case of each of those geometries, describe an horizontal plane. In each case the force required to cause flexural resonance in another plane is greater than that for establishing oscillation within an horizontal plane, therefore the latter being a preferred mode. However, while each of the discharge bores is shown to be symmetrically placed in these figures, an alteration in placement will have an influence on the surface described during oscillation. In each case, offsetting the bore will have a tendency to create an arcuate component while the principal movement remains in a generally horizontal disposition.

Figure 22:
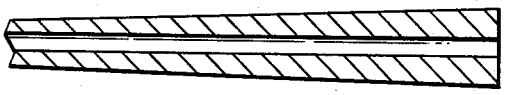
FIG. 22 is a sectional view of a geometric gradient for a reverse-tapered discharge tube in accordance with the present invention, providing a discharge surface in the nature of a processing circular discharge surface.
Figure 23:
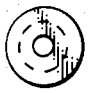
FIG. 23 is an end elevational view of the nozzle of FIG. 22.

FIGS. 22 and 23 illustrate a flexible tube having a circular geometry, but one where the discharge tube tapers outwardly along its length toward the distal end. This will result in a circular surface being described upon flexural movement of the discharge tube as the same precesses about its axis during the oscillatory movement. Accordingly, taper (i.e., a longitudinal cross-sectional gradient) may be combined with bore placement and transverse cross-sectional shape to permit further tailoring of a desired discharge surface described upon oscillation of the discharge tube. Thus, these longitudinal and/or transverse cross-sectional gradients in geometry of the mass comprising the tube (as opposed to a slit or removal or addition of material at the tip) provide "motion-affecting" means or "motion-affecting" control for the nozzle.

Figure 24:
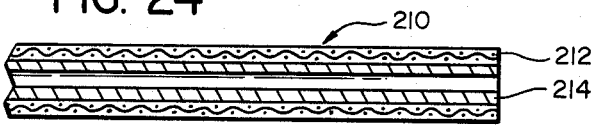
FIG. 24 is a side sectional view of an alternate, composite construction for a discharge tube in accordance with the present invention.

FIG. 24 shows a further variant upon the basic nozzle structure in accordance with the present invention. In this embodiment, a flexible tube designated generally as 210 is formed as a composite of a mesh cylinder 212 coated and impregnated with an elastomeric material, such as silicone layer 214. The elastomeric component imparts the desired and required flexible resiliency giving rise to oscillation of the tube 210 upon the discharge of a pressurized fluid stream, while the mesh imparts added integrity. Furthermore, while sacrificing the ability for substantial radial distention due to the presence of the mesh component, in situations where entrained particulate within the discharge stream is to be encountered the mesh will serve to protect the more sensitive elastomer and contribute to greater longevity of the nozzle.

Figure 25:
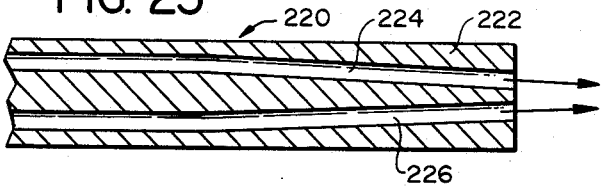
FIG. 25 is a sectional view of a mixing-type discharge tube for a nozzle in accordance with the present invention, whereby plural pressurized fluid streams may issue and be balanced to provide a controlled oscillatory motion describing a generally horizontal planar surface or be imbalanced to alter that described surface.
Figure 26:
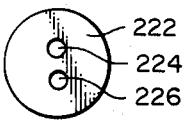
FIG. 26 is an end elevation view of the nozzle of FIG. 25.

FIGS. 25 and 26 exemplify a discharge tube for a nozzle in accordance with the present invention, designated generally as 220, particularly adapted for the mixing of plural fluid streams under controlled conditions. In this embodiment, an elastomeric tube 222 is formed with first and second fluid bores 224 and 226, respectively. The two fluid bores are disposed symmetrically with respect to the cross-section of the tube 222 are are, in this embodiment, identical. Consequently, as first and second fluid streams are admitted to the two fluid bores and balanced with respect to the flow through each, the tube 222 will tend to oscillate in a normal flexurally resonant vibrational mode in accordance with the general principles described above. As fluid emanates from the tip of tube 222, the convergence of the two fluid bores as best viewed in FIG. 25 will effectuate a mixing of the two compositions. On the other hand, should one or the other fluid stream cease to flow through the tube, an imbalance in the vibrational characteristics of the tube 222 will result as the remaining stream now issues through a bore offset from the axis of the tube. Coupled with the ability to recirculate fluid through use of a nozzle in accordance with the present invention, this gives rise to a particularly distinct advantage in fluid mixing and recovery.

Let it be assumed, for example, that one wishes to mix fluids "A" and "B" and recover the mixture "AB". Admitting the two compositions separately to respective different ones of the bores within tube 222 facilitates that mixing, and placement of the discharge nozzle vis-a-vis a first vessel permits one to collect that admixture. Next, let it be assumed that one of the sources "A" or "B" is depleted, whereupon flow through one or the other of the bores 224 or 226 ceases. Depending upon which flow terminates, the tube 222 will begin oscillation describing a discharge surface having a locus of points offset from the axis of the tube due to the offset disposition of the bore through which fluid continues to flow. That will shift the direction of spray from that theretofore existing upon balance of the two streams. Again, with proper placement of the nozzle relative to the vessel for collecting the admixture, and the further incorporation of first and second recovery vessels, the unmixed remaining flow may be recovered separately for recirculation until such a time as flow of the terminated stream can be reestablished.

Figure 27:
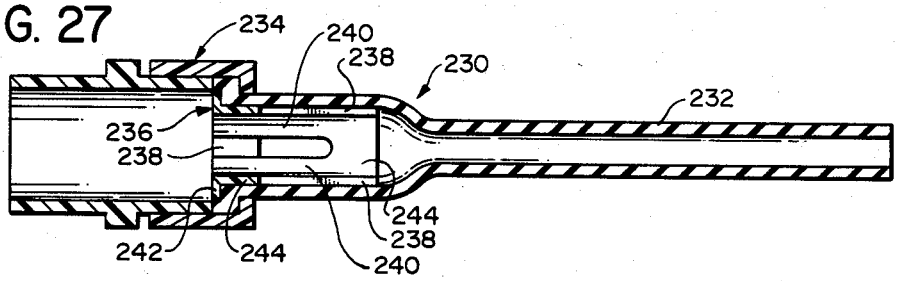
FIG. 27 is a side sectional view showing an expansible fitting for a nozzle in accordance with the present invention.
Figure 28:
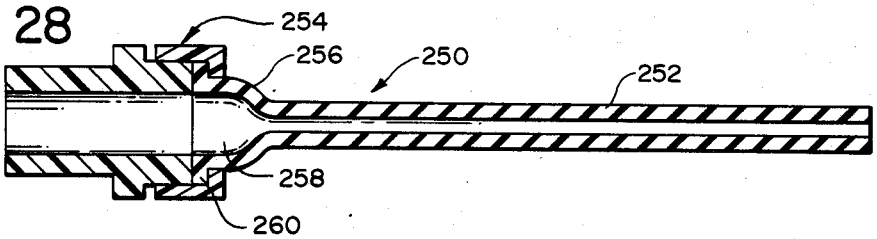
FIG. 28 is a side sectional view of an alternate design for a discharge tube and an associated fitting adapted to pass oversize particulate matter; and, FIG. 29 is a side sectional view of another alternate design for a discharge tube and an associated fitting, here adapted both to pass oversize particulate matter and also to allow positioning of the discharge tube about a type of ball joint.
Figure 29:
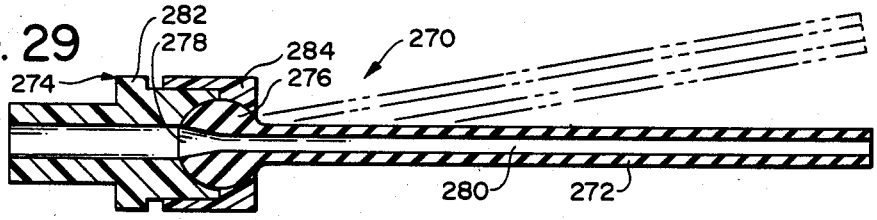

FIGS. 27–29 illustrate various alternative embodiments for a nozzle in accordance with the present invention and associated fittings therefor. In each case, the combination is one which tolerates the presence of oversized foreign particulate.

FIG. 27 illustrates a discharge nozzle, designated generally as 230, comprised of a flexible tube 232 borne upon and secured by a fitting 234 having an internal insert 236. As recounted above, the flexible tube member of the nozzles in accordance with the present invention are most preferably secured externally circumjacent the proximal end thereof in order that the fluid bore presents a cross-sectional dimension at least effectively equal to the fluid piping upstream of the nozzle member. The particular configuration of the fitting 234 allows insert 236 to be disposed interiorly of the tube 232 while maintaining the ability of the nozzle to clear or otherwise pass oversized foreign particulate. This is achieved by forming the insert 236 from a resiliently flexible material and segmenting the same across plural slitted elements 238 to yield deflectable finger elements 240 disposed within the tube 232. The insert includes a flange member 242 in order to retain the same within the fitting. The fingers are bridged forwardly and rearwardly by transverse margins 244 about which those fingers may flex radially outward upon the presence of particulate. The dimension of the insert is selected to be slightly greater than the internal bore of tube 232, thereby requiring the tube to be stretched over the insert and restrained within the fitting. As particulate enters the fitting, the upstream fingers of the insert will flex outwardly about the forward margin to permit it entry within the throat region, and as it passes through the insert the downstream fingers will flex about the rearward margin to clear the particulate to the bore of tube 232; whereupon it will be expelled in the manner described with reference to FIGS. 1–3.

FIG. 28 shows a nozzle, designated generally as 250, comprised of a flexible tube 252 secured within a fitting 254. In this case, the fitting 254 is one which engages the tube externally thereof as opposed to the insert 234. The tube 252 is this embodiment includes a shoulder region 256 and a throat 258, much like the embodiment of, e.g., FIG. 1; save the fact that the throat area 258 is now substantially larger at the sacrifice of the material from which the shoulder 256 is fabricated. The tube 252 further includes a terminal flange member 260 for mating engagement with the fitting 254. In this embodiment, the throat area 258 is approximately equal in dimension to the feed tube supplying the fluid stream to the nozzle and therefore admits any particulate which is capable of passing through the distribution system. The wall dimension within the shoulder region 256 is preferably thicker than the wall region toward the distal end of the tube, in order to accommodate the somewhat greater pressures existing therein, but is considerably lesser in thickness as compared with, e.g., the embodiments of FIGS. 1 and 4. Alternatively, some reinforcement material might be provided about the shoulder region to improve its resistance to these higher pressures. Regardless, particulate which enters the throat will cause radial distension of the tube as it progresses along the narrowing arcuate channel of throat 258 and begins to enter the bore of the distal end of tube 252. Once it begins to lodge within the bore, it will progress and ultimtely be expelled from the tube as recounted above with respect to FIGS. 1–4.

FIG. 29 shows another variety of nozzle in accordance with the present invention, designated generally as 270. This nozzle is comprised of a flexible tube 272 received within a fitting 274. In this instance, the proximal end of tube 272 is formed with a generally spherical shoulder region 276 having a throat 278 leading to a bore 280. The fitting is comprised of a first stationary member 282 in threaded engagement with an outer member 284. Each of the members 282 and 284 is formed with a complementary spherical geometry, and the same are dimensioned to exert a slight compressive force about the external periphery of the shoulder region 276 when in threaded engagement, thereby restraining the tube during normal operation. As with the preceding structures, the shoulder region 276 and enlarged throat 278, in combination with the resilience of the elastomer (from which tube 272 is made) will accommodate oversized particulate material. The particular advantage of the construction shown in FIG. 29 is that the shoulder region in combination with fitting 274 comprise a type of "ball joint; allowing the tube to be positioned in any desired orientation simply by loosening the outer fitting member 284, manipulating the tube to the desired position, and then resecuring the fitting. The ability to position and resposition the tube allows one to tune a spray pattern within, e.g., an effluent treatment apparatus in order to achieve the best dispersion of fluid vis-a-vis the path of effluent therein. Furthermore, where the tube 272 is formed with vanes to functions either as a type of fan or as a mixer in a liquid environment, the structure permits one to make whatever adjustment in positioning is desirable or necessary to meet the task at hand.

Recapitulating briefly, the nozzle of the present invention is capable of conducting at least one pressurized fluid stream and expelling same in a dynamically variable pattern for dispersing and/or mixing same with(in) an ambient fluid, making use of a resiliently flexible fluid discharge tube having an effective length at least equal to one harmonic wavelength of a coupled fluid stream for flexural resonant vibration of the tube as the fluid stream(s) issue(s) therefrom. The tube may be configured to include a geometric gradient in the transverse cross-sectional profile and/or the longitudinal cross-sectional profile in order to tailor the oscillatory characteristics thereof and, in turn, the shape of the discharge surface described by the moving tube. The tube may include one or more fluid bores, which may be discrete or intersecting depending upon the requirements of the task at hand. In any of these events, the bore location(s) and the overall cross-sectional geometries may be symmetrical as respects the longitudinal and/or transverse axes of the tube, or may be asymmetrical in respect thereof. Certain embodiments include an enlarged shoulder region at or near the proximal end, which itself conforms generally to a geometric gradient within the longitudinal cross-sectional profile; which shoulder is adapted to permit the passage of oversized particulate by radial distension in order to allow that foreign matter to progress through the tube under the head pressure of the fluid stream. Other variations in cross-sectional geometries adapt the discharge nozzle to conduct a fluidized particulate stream and centralize the particulate component substantially along the longitudinal axis of the tube. Still other geometric variations, and particularly in the transverse cross-sectional profile, may be imparted in order for the moving tube to create turbulence within the ambient fluid upon flexural movement, thereby allowing the discharge nozzle to be adapted to serve as a fan means, a fluid mixer means, or indeed a water craft propulsion means. Along these lines, the vanes for creating turbulence within the ambient fluid may take on any one of a number of forms, including planar, arcuate, helical flights, and the like to serve as a fluid pumping surface, the particular shape giving predictable results with due consideration for the material from which the tube is constructed and the ambient fluid (i.e., viscosity). Furthermore, the vanes themselves may be integral with the tube or may comprise an insert or sleeve disposed over the tube.

Given the foregoing, very broad adaptability of the present invention, which has now been described with reference to a number of preferred embodiments thereof, those skilled in the art will appreciate that various substitutions, omissions, changes and modifications may be made without departing from the spirit thereof. Accordingly, these descriptions have been made solely for the purpose of exemplification and should not be deemed limitative on the scope of the claims granted herein.

What is claimed is:

1. A nozzle for expelling a fluid stream in a dynamically variable pattern comprising a resiliently flexible tube having a bore, a proximal end, a distal end and an effective length at least equal to one harmonic wavelength of a coupled fluid stream for flexural resonant vibration of said tube as said stream is conducted therethrough, wherein said proximal end includes an enlarged, plastically deformable shoulder region for radial distension upon passage of particulate matter having a dimensional aspect greater than the bore dimension of said tube.

2. The nozzle of claim 1, wherein said tube includes an enlarged throat at the proximal end thereof.

3. The nozzle of claim 2, wherein said shoulder region is disposed within a nozzle fitting and projects outwardly therefrom.

4. The nozzle of claim 3, wherein said shoulder region is a generally spherical shoulder disposed within a fitting of generally complementary geometric configuration comprising a tube positioning means.

5. The nozzle of claim 3, wherein said throat extends substantially through said shoulder region along the longitudinal axis of said tube to a juncture of said shoulder with a medial region of said tube.

6. The nozzle of claim 1, wherein said stream is comprised of a fluidized particulate stream and further wherein said tube includes an internal bore geometry configured for centralizing particulate flow substantially along the axis thereof.

7. The nozzle of claim 6, wherein said bore geometry is comprised of an axially stepped geometry.

8. The nozzle of claim 7, wherein said tube includes a plurality of spaced annular rings having an outer diameter for conforming receipt within said bore and an inner diameter for conforming particulate flow substantially along said axis.

9. The nozzle of claim 6, wherein said bore geometry is a land and groove geometry.

* * * * *